US006375164B1

(12) United States Patent
Siegler et al.

(10) Patent No.: US 6,375,164 B1
(45) Date of Patent: Apr. 23, 2002

(54) DOUBLE-TAPE PEDESTRIAN TRAFFIC CONTROL DEVICE AND METHOD OF ASSEMBLING IT

(75) Inventors: Stephen L. Siegler, Huntington Station; Pedro Rivera, Holtsville, both of NY (US)

(73) Assignee: Lawrence Metal Products , Inc., Bay Shore, NY (US)

( * ) Notice: Subject to any disclaimer, the term of this patent is extended or adjusted under 35 U.S.C. 154(b) by 0 days.

(21) Appl. No.: 09/335,572

(22) Filed: Jun. 18, 1999

(51) Int. Cl.[7] ..... E04H 17/00
(52) U.S. Cl. ..... 256/1; 256/24
(58) Field of Search ..... 256/1, 45, 46, 256/47, 49, 50, 37, 40, 41, 42, 12.5, 19, 32

(56) References Cited

U.S. PATENT DOCUMENTS 3,688,440 A * 9/1972 Applegarth et al.
3,917,231 A * 11/1975 Fink
3,977,654 A * 8/1976 Etherington et al.
4,124,196 A * 11/1978 Hipskind ..... 256/1
4,844,420 A * 7/1989 Oster
5,050,846 A * 9/1991 Goodman et al.
D343,690 S * 1/1994 Carey
5,660,144 A * 8/1997 Venti
5,690,317 A * 11/1997 Sandsborg

* cited by examiner

*Primary Examiner*—Lynne H. Browne
*Assistant Examiner*—Tomlyne A Malcolm

(57) ABSTRACT

A double-tape pedestrian traffic control device including a hollow, one piece post having an open upper end, and at least one slot in the post about midway between its ends. A first cassette is mounted on the upper end of the post and a second cassette is located within the post at the level of the slot. Each cassette contains a tape wound on a spool, the spool being spring-biased to rotate in a direction which winds the tape on to the spool. The tape of each cassette is extendable from that cassette in a direction generally perpendicular to the vertical axis of the post, the tape of the second cassette extending through the slot in the post. The diameter of the second cassette, along its entire axial length, is smaller than the internal diameter of the post, so that the second cassette can be inserted into the open upper end of the post and moved to its location between the ends of the post. The second cassette is furnished with means for maintaining tension in the retractor spring prior to and during insertion of the second cassette into the post, the tension-maintaining means being positioned substantially within the confines of the outer dimension of the second cassette, so as not to interfere with insertion of the second cassette into the post. After the free end of the tape of the second cassette is manipulated outwardly through the slot in the post, a pull is attached to the free end of the tape, the pull being too large to fit through the slot and hence preventing full retraction of the tape into the cassette.

13 Claims, 9 Drawing Sheets

DOUBLE-TAPE PEDESTRIAN TRAFFIC CONTROL DEVICE AND METHOD OF ASSEMBLING IT

This invention relates to pedestrian traffic control barriers of the type including a vertical post, and a cassette mounted on the upper end of the post, the cassette incorporating a flexible tape wound on a spool, the tape being extendable in a horizontal direction from the post. The tape is extended by pulling on its free end, causing the tape to unwind from a spool within the cassette against the force of a retractor spring tending to rotate the spool so as to rewind the tape. The free end of the tape is attached to the upper end of another similar post, or in some cases to a fixed bracket on a wall, so as to establish the barrier for guiding pedestrian traffic.

In some cases, it is desirable to provide a second cassette, about midway between the upper and lower ends of the post, so that a second tape can be drawn between the two posts, the two tapes being parallel to each other and one above the other. Such a double-tape pedestrian barrier offers a number of advantages, including extra security to protect restricted areas and valuable displays, discouraging people from "ducking under" the barrier, helping to keep children in line, and providing added guidance for the visually impaired.

In the past, double-tape pedestrian traffic control devices have been assembled in a number of ways. One approach has been to employ a two-piece post so that the lower cassette can be readily inserted into the upper end of the lower section of the post, after which the two sections of the post are assembled and the second cassette mounted on the upper end of the top section of the post. This approach is unsatisfactory because of the extra expense involved in time and materials when dealing with a two-piece post, not to mention the unattractive appearance of a two piece post as compared to a one-piece post.

Another method which has been used to provide a second, lower tape involves use of a cassette provided with a generally semicircular bracket which fits on to the outer circular contour of a post and is fastened to the exterior of the post. This arrangement is unattractive because of the exposed bracket on the exterior of the post and the fact that the cassette projects from the post rather than being incorporated within it.

It is a general object of the present invention to provide a double-tape pedestrian traffic control device employing a one-piece post which incorporates the second, or lower, cassette within the post.

To accomplish this objective, it was necessary to overcome certain problems. As a preliminary matter, it should be explained that in the traditional cassette, mounted at the upper end of the post, tension is retained in the retractor spring even when the tape is fully wound on the spool. The reason is that it is desirable for the tape to be strongly and completely pulled back into the cassette, when the barrier is being rearranged, and if there is little or no tension in the retractor spring when the tape is fully wound, retraction of the tape, near the end of the retraction movement, will be sluggish.

In the conventional cassette mounted on the upper end of the post, several narrow brackets parallel to the axis of the cassette are carried by the cassette around its periphery. One of these brackets is formed with a narrow slot through which the tape passes. A pull is fastened to the free end of the tape, outwardly of the bracket, the pull being grasped by the fingers of the user in order to pull the tape from the cassette. The pull is wider than the slot in the bracket, and hence when the pull engages the bracket, further rotation of the spool by the retractor spring is terminated, even though the retractor spring remains tensioned.

It may also be mentioned that in the conventional cassette, the upper end of the cassette is usually larger than the internal diameter of the post. As a result, when the cassette is inserted into the upper end of the post, the upper end of the cassette engages the upper end of the post and limits the movement of that cassette into the post.

Thus, in order to incorporate a second cassette into the post about midway between the ends of the latter, the external diameter of the cassette along its entire length must be smaller than the internal diameter of the post. Moreover, the brackets and pull normally preassembled with the cassette must not be present, since these elements will prevent insertion of the lower cassette into the post. However, upon removal of the brackets and pull, there is nothing to prevent rotation of the tape spool by the retractor spring until the spring is completely untensioned, which as mentioned above is an undesirable circumstance.

It is, therefore, another object of the invention to provide a double-tape pedestrian traffic barrier in which a second, or lower, cassette is insertable into a post to a point between its ends, and yet in which tension is maintained in the retractor spring even though the tape is fully wound on the cassette spool.

Additional objects and features of the invention will be apparent from the following description, in which reference is made to the accompanying drawings.

In the drawings

Figure 1:
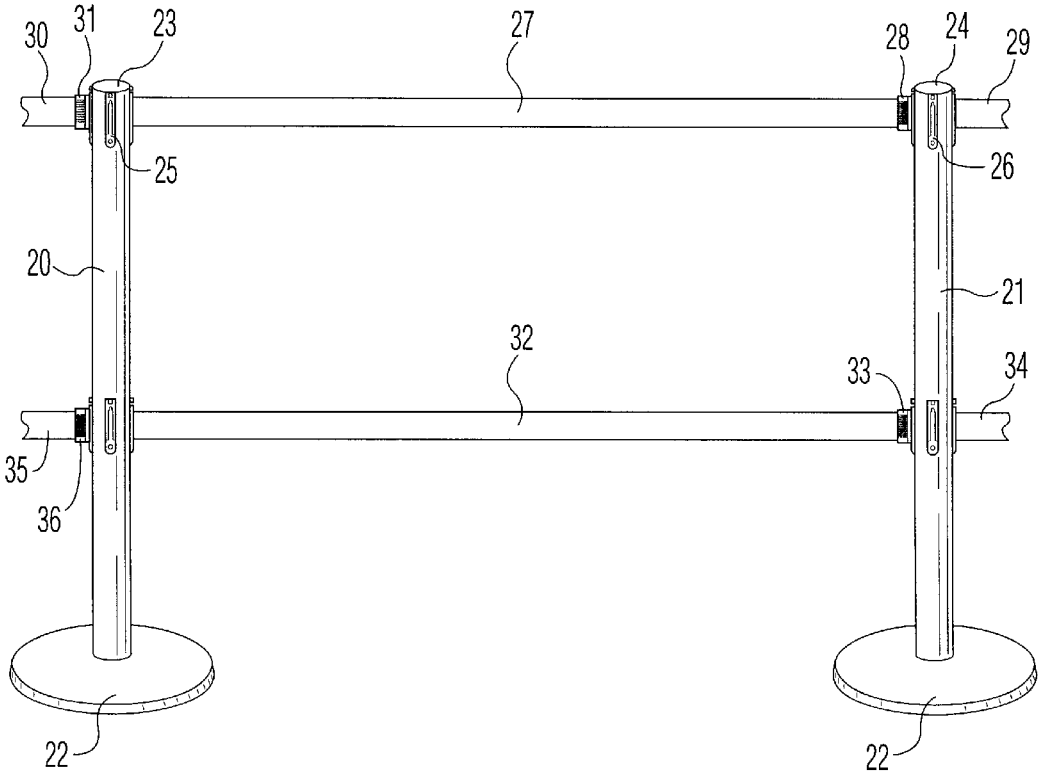
FIG. 1 is a perspective view of a double-tape pedestrian traffic control device according to the present invention.

A double-tape pedestrian traffic control device chosen to illustrate the present invention is shown in FIG. 1. The device includes two, spaced-apart upright posts 20 and 21, each mounted on a supporting base 22. Each post 20 and 21 is hollow for all or most of its length. A tape-containing cassette 23 is accommodated within the open upper end of post 20, and a similar tape containing cassette 24 is accommodated within the open upper end of post 21.

As will be described more fully below, each cassette 23 is provided with four axially-extending exterior brackets 25 (only three such brackets being shown in FIG. 1), each bracket being formed with parallel undercut grooves along its sides. Similarly, A flexible tape 27, made of any suitable material such as woven fabric, is shown extending from cassette 23 to post 21, at which point a pull 28 attached to the free end of tape 27 is secured to one of the brackets 26 of cassette 24. The pull is formed with undercut ridges which slidingly cooperate with the grooves in bracket 26 to secure the end of tape 27 to cassette 24, and thus prevent tape 27 from being rewound into cassette 23.

A fragment of tape 29 is shown extended from cassette 24 toward another upright post (not shown) so as to continue the traffic control barrier. Similarly, a fragment of tape 30 is shown extending to post 20 from a previous post (not shown) in the series of posts, a pull 31 at the end of tape 30 securing the tape to post 20. As many posts as necessary are employed to provide the required length of barrier. As thus far described, the traffic control device is conventional.

According to the present invention, a second cassette (not shown) is located within post 20 at a selected level beneath the top of the post, such as about midway between the upper and lower ends of the post. At this point, the post is provided with a slot, and tape 32 is shown extending from the second, or lower, cassette to post 21. At this point, a pull 33 carried by the free end of tape 32 is used to secure the free end of the tape to the bracket of a lower cassette (not shown) mounted within post 21. A fragment of tape 34 is shown extending from the lower cassette in post 21 toward another post (not shown). Also, a fragment of a tape 35 is shown, this tape extending from the lower cassette of a previous post (not shown) in the series of posts, the pull 36 at the end of tape 35 securing the tape to post 20.

Figure 2:
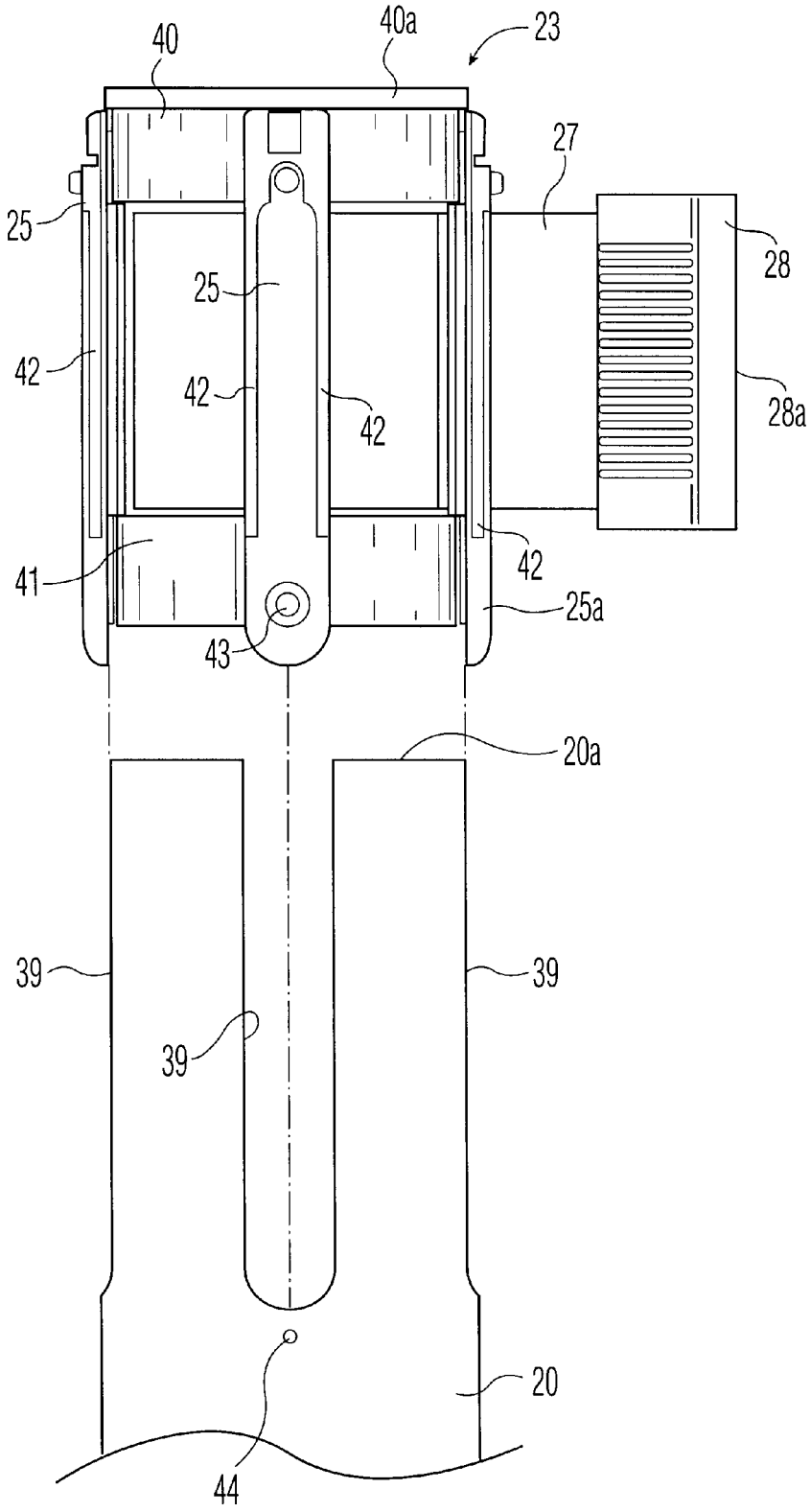
FIG. 2 is an exploded view of the upper end of a post shown in FIG. 1 and a conventional tape cassette mountable on the upper end of the post.

FIG. 2. illustrates the conventional structure of the upper end of a post, such as post 20, and the conventional upper cassette 23 adapted to be accommodated within the upper end of the post. The upper end of post 20 is formed with four vertical slots 39 formed in the post at 90° intervals. Cassette 23 comprises upper end cap 40 and lower end cap 41 which rotatably support between them a spool (not shown) upon which tape 27 is wound. Within end cap 41 is a spiral retractor spring (not shown) tending to rotate the spool in a direction which winds tape 27 on to the spool. End caps 40 and 41 are held together by four brackets 25, spaced at 90° intervals around the cassette, one of the brackets 25*a* being formed with a narrow slot which permits tape 27 to freely pass through it. Each bracket 25 is formed with two parallel undercut grooves 42. The free end of tape 27 carries a pull 28 which, because of its size, cannot fit through the slot in bracket 25*a*. In this way, the retractor spring is prevented from completely winding the free end of tape 27 on to the spool. The end face 28*a* of pull 28 is formed with an undercut groove which can slidably cooperate with a bracket 26 (FIG. 1) so as to secure the pull and the free end of tape 27 to another post, e.g., post 21.

Cassette 23 is assembled with the upper end of post 20 by sliding the cassette downwardly into the post, brackets 25 being accommodated by slots 39. Movement of the cassette into the post continues until the enlarged diameter top 40*a* of end cap 40 engages the upper edge 20*a* of post 20, thereby limiting further movement of cassette 23 into the post. Conventionally, screws are then fitted through holes 43 at the lower ends of brackets 25 and threaded into holes 44 in the post just beneath slots 39.

Figure 3:
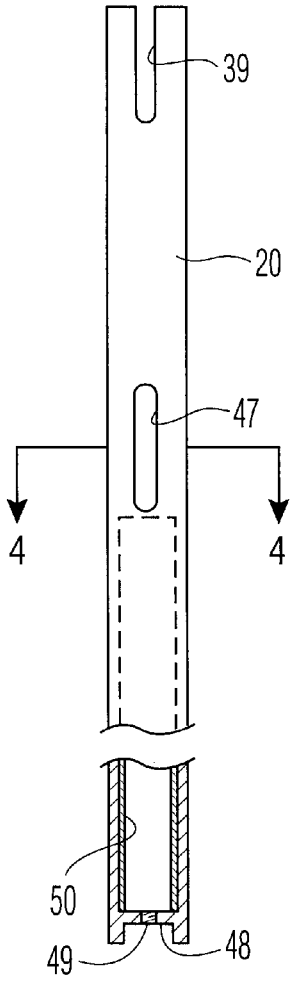
FIG. 3 is an elevational view, partially in cross-section, showing a post usable with the present invention.
Figure 4:
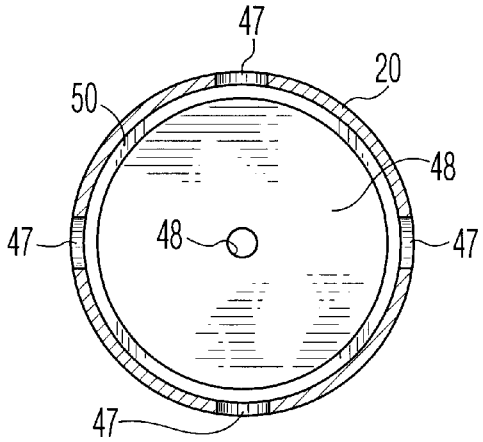
FIG. 4 is a horizontal cross-sectional view along line 4—4 of FIG. 3.
Figure 5:
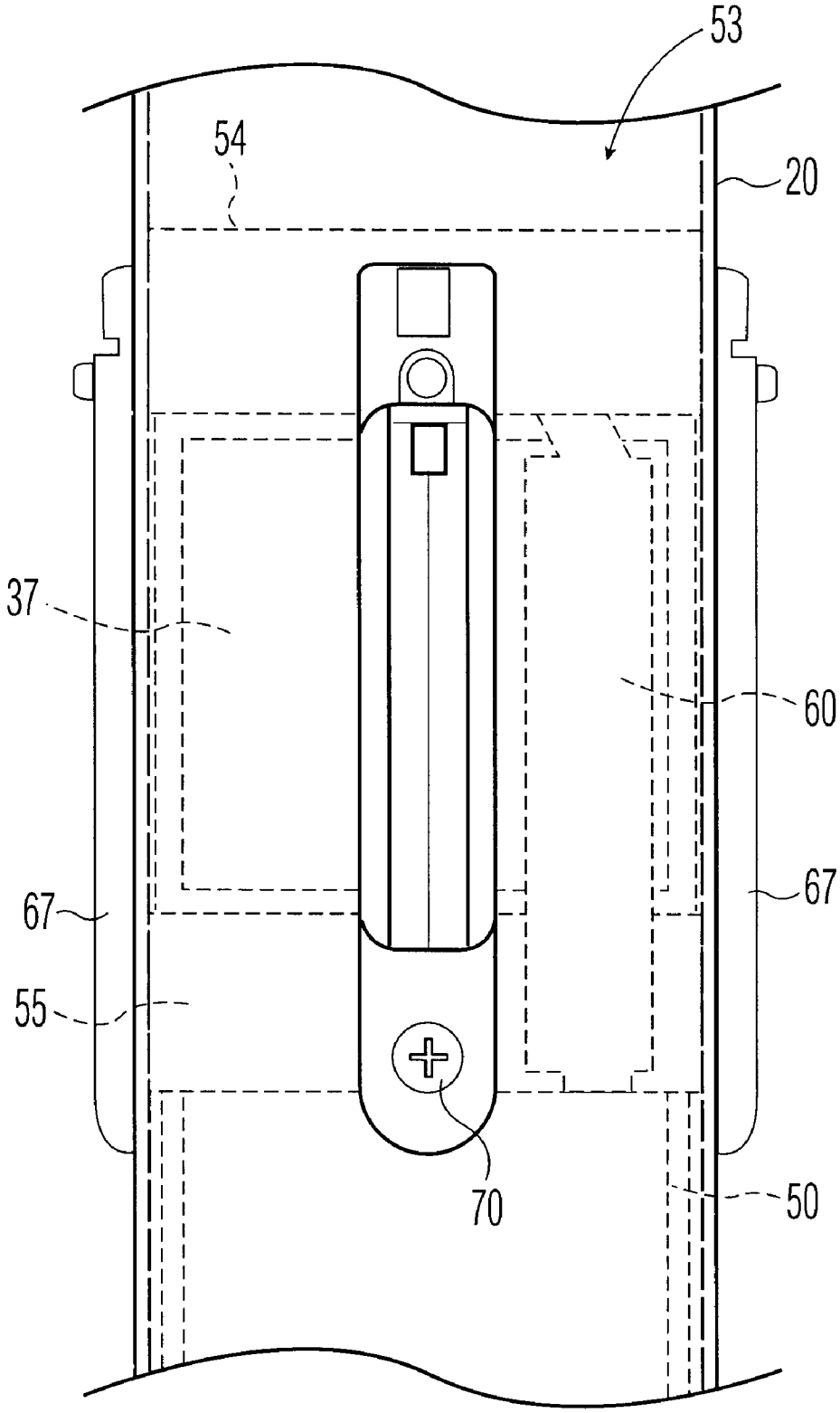
FIG. 5 is a fragmentary elevational view showing a cassette according to the present invention located within a post.
Figure 6:
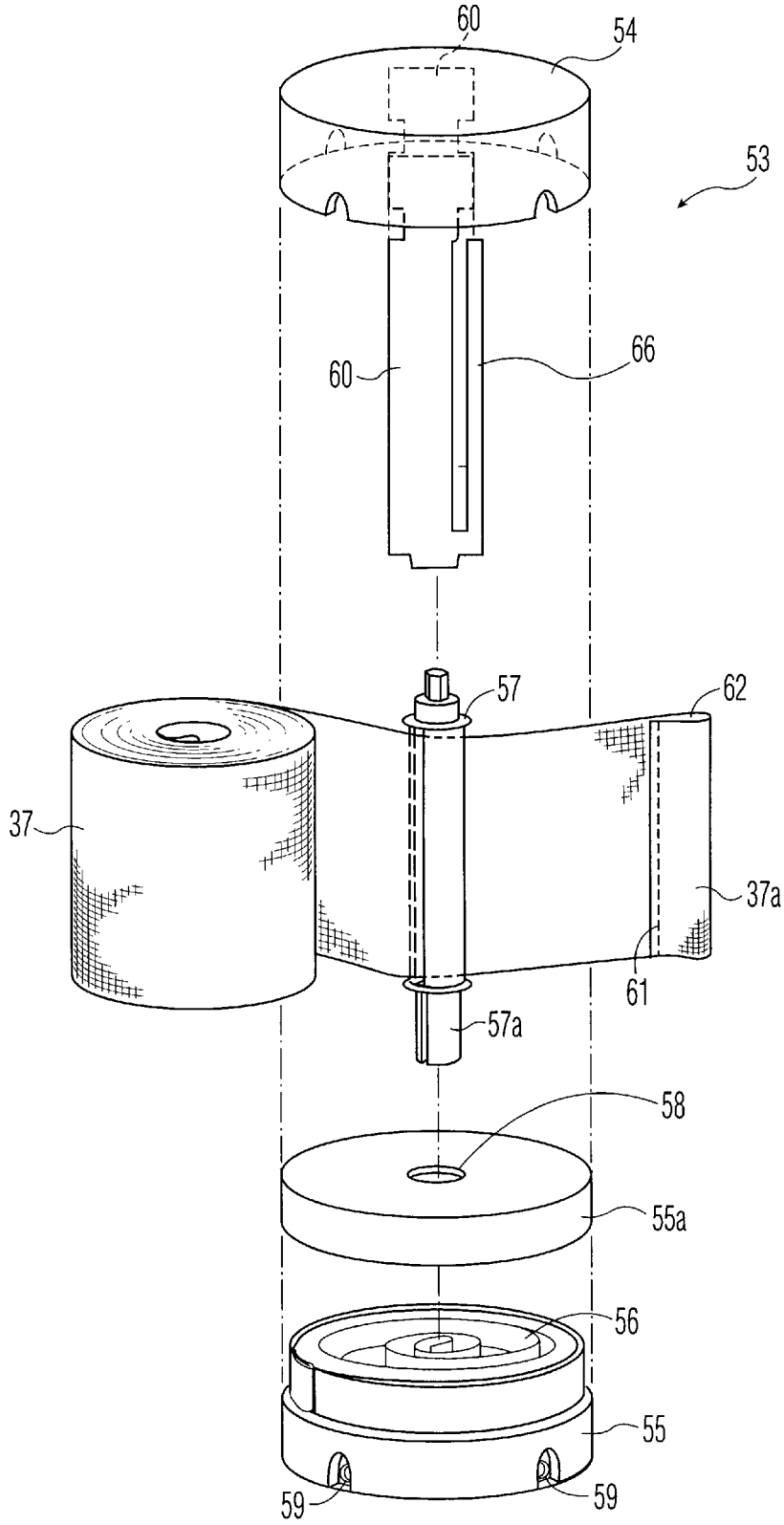
FIG. 6 is an exploded perspective view showing a cassette according to the present invention.
Figure 7:
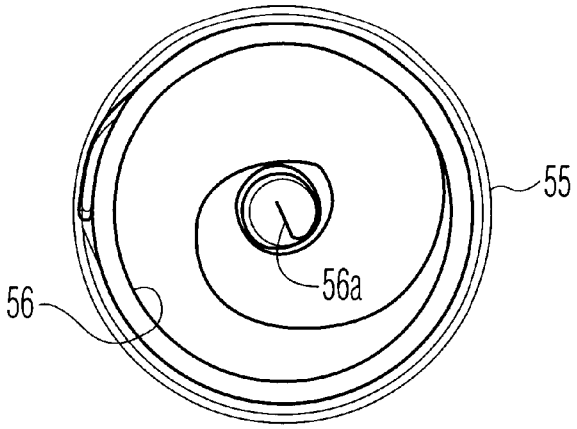
FIG. 7 is a plan view of the lower end cap of a tape cassette, showing the retractor spring.

According to the present invention, as illustrated in FIGS. 3 and 4, each post, e.g., 20, of the pedestrian traffic control device is formed with a slot 47 intermediate the upper and lower ends of the post, and preferably about midway between those two ends. Post 20 may be formed with four slots 47, each vertically aligned with one of the slots 39 in the post. Typically, post 20 is closed at its lower end by a wall 48 containing an internally threaded hole 49 which accommodates a threaded stud projecting upwardly from a base 22 (FIG. 1). It is convenient to provide means for supporting the lower cassette within post 20 at the level of slots 47 until the cassette can be securely fastened in place. One way of achieving this result is to provide a tube 50 (FIGS. 3–5), which is dropped into tube 20 and rests upon bottom wall 48. The tube may be formed of any suitable rigid material, such as a plastic or fibrous material, and has a length such that its upper end is located at about or just below the level of the lower end of slots 47.

A lower cassette 53, according to the present invention, is shown in more detail in FIGS. 5–8. The cassette includes upper and lower end caps 54 and 55, the lower end cap containing a spiral retractor spring 56 and having a cover 55*a* for enclosing the spring within the lower end cap. A spool 57 is rotatably supported between the end caps, the lower end 57*a* of the spool fitting snugly, but rotatably, through a hole 58 in cover 55*a*. The lower end 57*a* of the spool has a diametrical slot which accommodates the end 56*a* of spring 56. By virtue of this interconnection of spool and spring, when the spring 56 is tensioned, it tends to rotate the spool in a direction which winds tape 37 on to the spool. Lower end cap 55 has four threaded holes 59, used after the cassette is assembled with tube 20. The upper and lower end caps 54 and 55, and hence the entire lower cassette assembly, are held together by at least one brace 60, formed of a suitable material such as sheet metal, the upper and lower ends of brace 60 attaching to the upper and lower end caps 54 and 55, respectively. Preferably, two such braces 60 are employed at approximately diametrically opposed locations around the cassette. The free end of 37*a* of the tape is turned back upon itself, and stitched at 61 to form a channel 62 used to cooperate with pull 33, as will be described in more detail with reference to FIG. 11.

The second or lower cassette 53 (FIGS. 5–8) differs from the first or upper cassette 23 (FIG. 2) in a number of significant respects. In general, cassette 53 has an outer diameter, along its entire axial length, which is smaller than the internal diameter of post 20. Thus, for example, upper end cap 54 does not have an enlarged diameter top, such as the enlarged top 40*a* of cassette 23. Therefore, no part of the upper end cap engages the top edge 20*a* of post 20 to limit movement of cassette 53 into the post.

In addition, end caps 54 and 55 of cassette 53 are not preassembled with brackets 25, which normally interconnect end caps 40 and 41 of cassette 23 and hold the cassette together as a unit. Instead, cassette 53 employs thin braces 60 to hold the cassette assembly together, and the braces 60 do not project outwardly beyond the generally cylindrical contour of the cassette.

Moreover, in the case of upper cassette 23, pull 28 is preassembled with the free end of tape 27, and therefore the pull serves the purpose of limiting the rewinding movement of the tape on to the spool by engagement of pull 28 with bracket 25*a*. In this way, tension is maintained in the retractor spring even when the tape is substantially fully wound on the spool.

In the case of cassette 53, pull 33 cannot be preassembled with the free end 37*a* of tape 37, since presence of the pull would prevent insertion of cassette 53 into tube 20 to its desired location at the level of slots 47. Therefore, the present invention provides other means, as illustrated in FIG. 8, for maintaining tension in retractor spring 56 when tape 37 is substantially completely wound on the spool.

Figure 8:
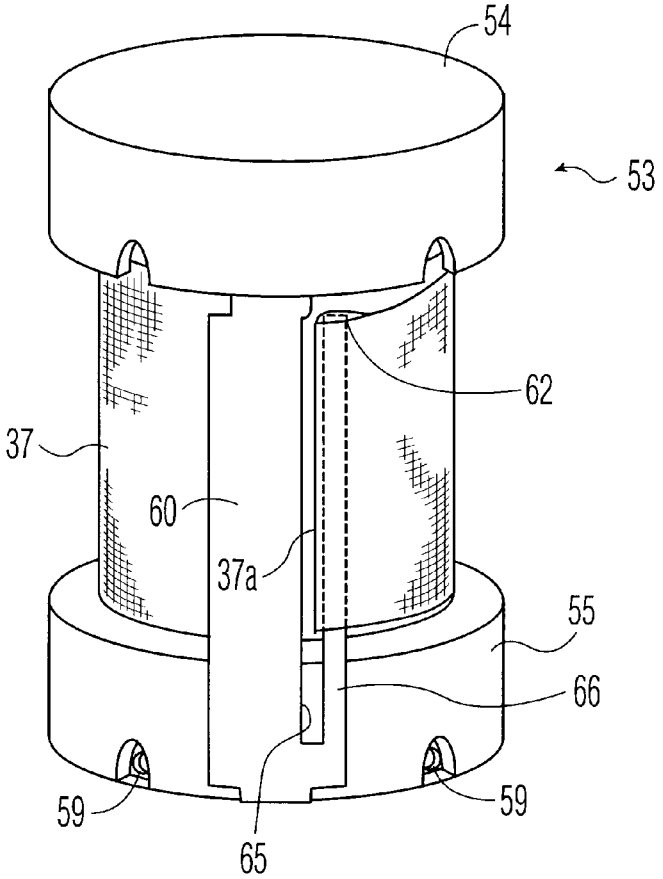
FIG. 8 is a perspective view of a cassette according to the present invention prior to insertion into a post.

FIG. 8 illustrates one way, according to the invention, of maintaining some tension in the retractor spring when the tape is substantially fully wound on the spool. At least one of the braces 60 is provided with a slot 65 near one of its longitudinal edges so as to define an axially-extending narrow finger 66. Free end 37*a* of tape 37 is slipped over the finger so that finger 66 is accommodated within channel 62.

Figure 9:
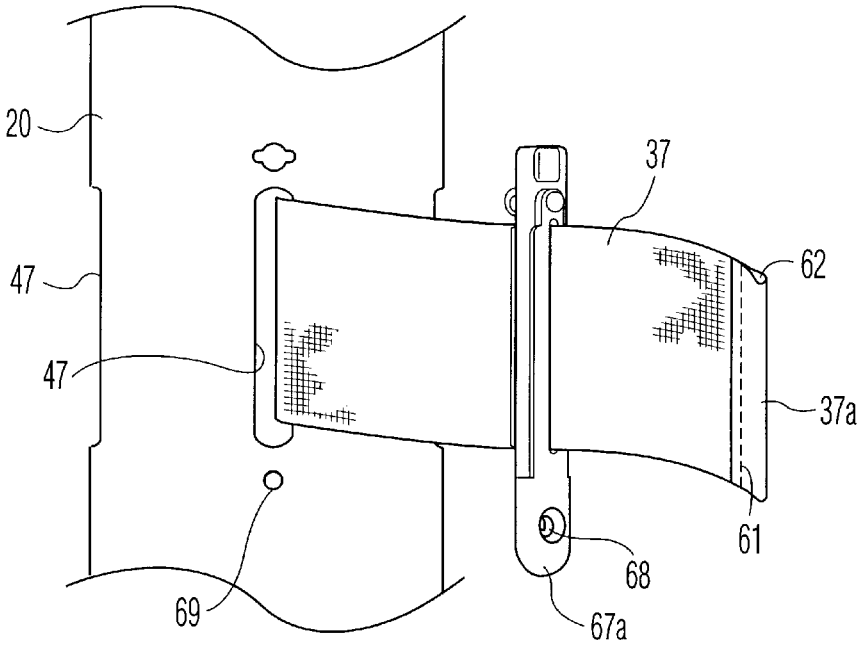
FIG. 9 is a fragmentary view showing the tape of the lower cassette being pulled through a slot in the post and a slot in a bracket, prior to mounting on the post.
Figure 10:
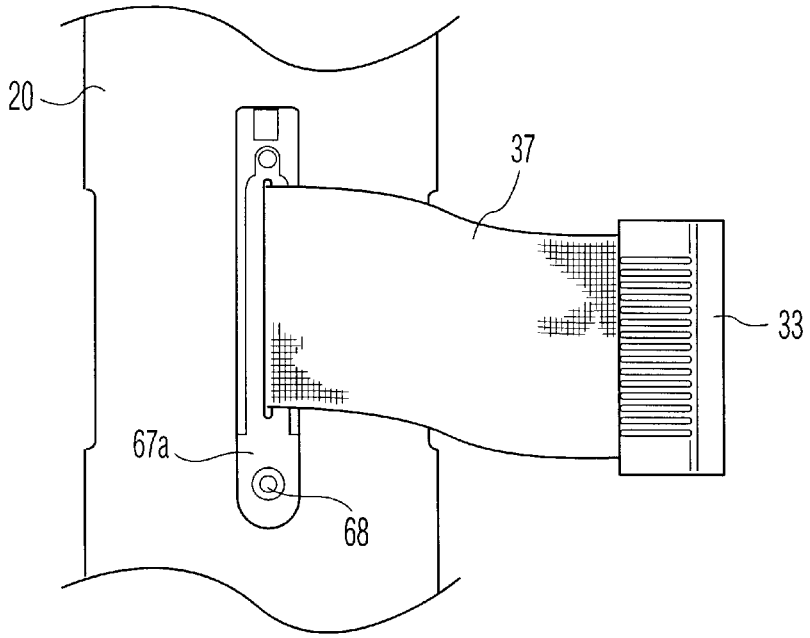
FIG. 10 is a view similar to FIG. 9 showing the bracket mounted on the post and a pull secured to the free end of the tape.

In this condition (FIG. 8), cassette 53 is inserted into post 20 and comes to rest on the upper edge of tube 50. Free end 37*a* of tape 37 is slipped off finger 66, this being possible because the finger is flexible, and the tape free end is manipulated through one of the slots 47 in post 20 (FIGS. 9 and 10). The free end 37*a* of tape 37 is then slipped through a slot in a bracket 67*a*, similar to the bracket 25*a* of cassette 23, after which pull 33 is attached to the free end of the tape (FIG. 10). Then, each bracket 67 is secured in place by a screw 70 (FIG. 5) which passes through a hole 68 in the bracket, a hole 69 in the post, and is threaded into a hole 59 in the lower end cap 55 of cassette 53. In this way, the brackets securely hold cassette 53 within post 20.

Figure 11:
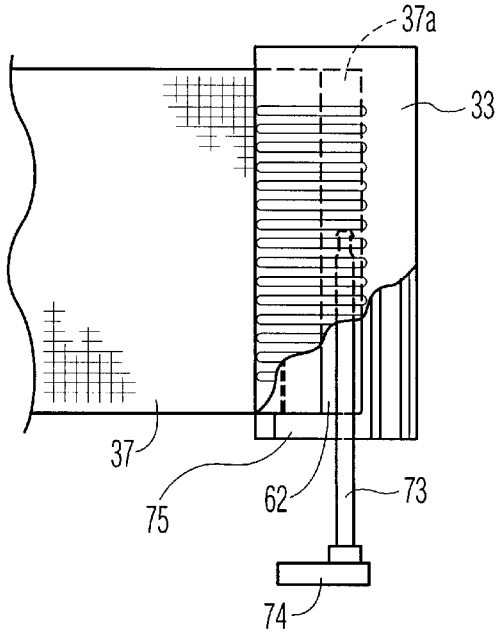
FIG. 11 is an elevational view illustrating the assembly of the pull with the free end of the tape.
Figure 12:
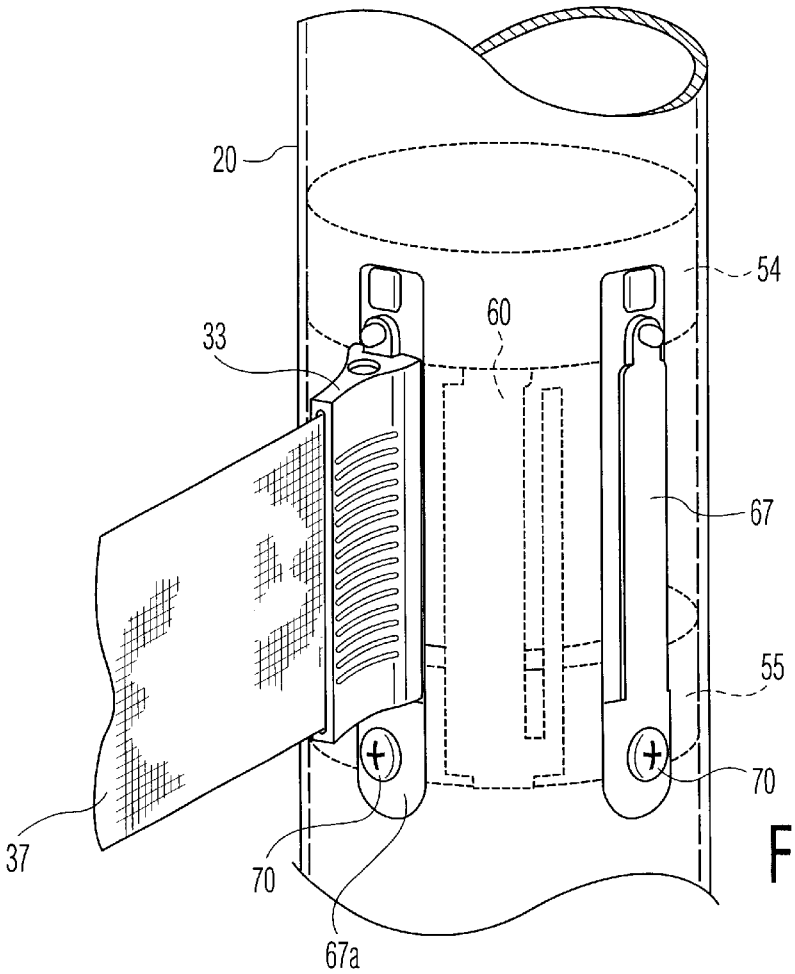
FIG. 12 is a perspective view showing the end of a tape extending from one post (not shown) attached to a second post.

As shown in FIG. 11, pull 33 may be secured to the free end 37*a* of tape 37 in a conventional manner. The free end of the tape is inserted into a hollowed-out portion of pull 33, after which a pin 73 is inserted into channel 62 at the free end of the tape until the head 74 of the pin snaps into a receptacle 75 in the pull.

Figure 13:
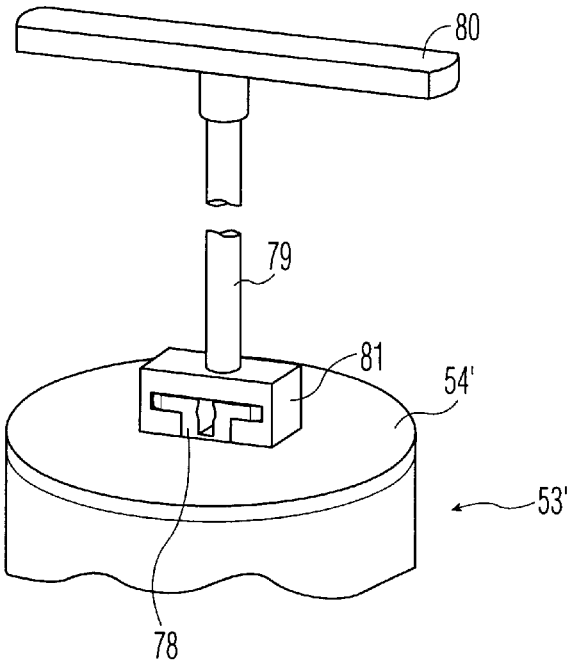
FIG. 13 is fragmentary perspective view illustrating an upstanding projection on the upper end of the lower cassette and a tool cooperable with the projection for lowering the cassette into a post and withdrawing the cassette from the post.

It is thought desirable to provide an aid for inserting the lower cassette into post 20 and lifting it out of the post, should it need replacement or repair. For this purpose, as shown in FIG. 13, the top wall 54' of lower cassette 53' may be formed with a T-shaped projection 78. A tool is provided comprising a rod 79 having a handle 80 at one end and a fitting 81 at its other end having a T-shaped slot. When needed, the upper cassette is removed from the post, rod 79 is inserted into the post, using handle 80, and fitting 81 is slipped over projection 78, so that the tool can then be used to lift cassette 53' out of the post. To insert a new cassette into the post, the procedure described above is reversed.

Figure 14:
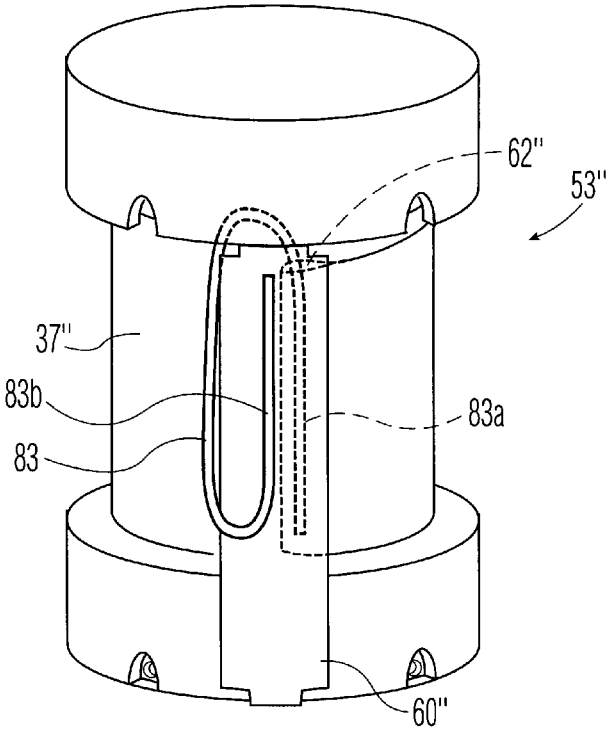
FIG. 14 is a view similar to FIG. 8 showing an alternative arrangement employing a clip.

FIG. 14 illustrates an alternative way of preserving tension in the retractor spring prior to and during insertion of lower cassette 53" into tube 20. In this case, brace 60" is not formed with a finger 66. Instead, a generally oval clip 83 is provided, the clip having overlapped end regions 83*a* and 83*b*. One end region 83*a* is inserted into channel 62" at the free end of tape 37". The end region 83*b* of clip 83 is fitted over an edge of brace 60" so as to lock the free end of tape 37" to brace 60".

After cassette 53" has been located within post 20, clip 83 is disengaged from brace 60" and pulled through one of the slots 47 in the post, bringing the free end of tape 37" with it. Then, as described above, bracket 67*a* and pull 33 are assembled with the tape.

Thus, it will be appreciated that the present invention provides a double-tape pedestrian traffic control device which utilizes a one piece post, and yet provides for the second or lower cassette being wholly accommodated within the post.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A double-tape pedestrian traffic control device, comprising:

a hollow upright, one piece, post having an open upper end and a lower end, at least one slot in the post between its ends, the slot being spaced from both ends of the post, a first cassette mounted on the post at its upper end, the cassette incorporating a tape wound on a spool, the tape being extendable from the cassette in a direction generally perpendicular to the axis of the post, and a second cassette located within the post and between its ends, the second cassette incorporating a tape wound on a spool, the tape being extendable from the cassette, through the slot in the post, in a direction generally perpendicular to the axis of the post and means for holding the second cassette within the post.

2. A double-tape pedestrian traffic control device as defined in claim 1, wherein the outer diameter of the second cassette, along its entire axial length, is smaller than the internal diameter of the post, so that the second cassette can be inserted into the open upper end of the post and moved to its location between the ends of the post.

3. A double-tape pedestrian traffic control device as defined in claim 2, wherein the lower end and tape-wound spool portion of the first cassette fit within the post, but the upper end of the first cassette is larger than the internal diameter of the post, so that engagement of the upper end of the first cassette and the upper edge of the post limits the movement of the first cassette into the post.

4. A double-tape pedestrian traffic control device as defined in claim 1 including means for supporting the second cassette within the post in the region of the slot in the post.

5. A double-tape pedestrian traffic control device as defined in claim 4 wherein the support means includes a tube within the post having an upper end in the region of the lower end of the slot in the post, the second cassette being seated upon the upper end of the tube.

6. A double-tape pedestrian traffic control device as defined in claim 1 including a retractor spring within the second cassette tensioned to rotate the cassette spool so as to wind the tape on to the spool, and means for maintaining tension on the spring when the tape is fully wound on the spool and prior to insertion of the second cassette into the post, the tension-maintaining means being positioned substantially within the confines of the outer dimension of the second cassette, so as not to interfere with the insertion of the second cassette into the post and its movement to a location within the post.

7. A double-tape pedestrian traffic control device as defined in claim 6 wherein the second cassette includes two axially spaced-apart end caps, the spool being between the end caps and rotatably supported therein, at least one bracket interconnecting the two end caps to hold the cassette parts together as a unit, and the tension maintaining means including means for temporarily joining the wound tape to the bracket.

8. A double-tape pedestrian traffic control device as defined in claim 7 wherein the joining means temporarily secures the free end of the wound tape to the bracket.

9. A double-tape pedestrian traffic control device as defined in claim 7 wherein the free end of the wound tape is turned back upon itself to form a channel transverse to the length of the tape, and the joining means includes a finger carried by the bracket adapted to be inserted into the channel.

10. A double-tape pedestrian traffic control device as defined in claim 9 wherein the finger is integrally formed with the bracket.

11. A double-tape pedestrian traffic control device as defined in claim 7 wherein the free end of the wound tape is turned back on itself to form a channel transverse to the length of the tape, and the joining means includes a clip having one end region adapted to be accommodated by the channel and another end region adapted to engage the bracket.

12. A method of assembling a double-tape pedestrian traffic control device, the device including a hollow post having an open upper end and a slot between and spaced from the post ends, and a cassette incorporating a spool on which a tape is completely wound, the free end of the tape being exposed, the method including the steps of:

inserting the cassette into the open end of the post, maneuvering the cassette along the length of the post until the free end of the tape is accessible through the slot in the post, pulling the free end of the tape through the slot, and attaching a finger pull to the free end of the tape exposed outside the post, the pull being sized large enough so that the free end of the tape, with pull attached, cannot be retracted into the post through the slot.

13. A method as defined in claim 12 wherein the tape-carrying spool is spring biased in a direction tending to wind the tape on the spool, so that pulling the free end of the tape through the post slot adds tension to the spring.

* * * * *